US007878095B2

(12) United States Patent
Wu

(10) Patent No.: US 7,878,095 B2
(45) Date of Patent: Feb. 1, 2011

(54) RECIPROCATABLE OPEN END WRENCH

(75) Inventor: Arthur Wu, Taichung (TW)

(73) Assignee: Proxene Tools Co., Ltd., Taichung (TW)

( * ) Notice: Subject to any disclaimer, the term of this patent is extended or adjusted under 35 U.S.C. 154(b) by 253 days.

(21) Appl. No.: 12/237,565

(22) Filed: Sep. 25, 2008

(65) Prior Publication Data

US 2010/0071516 A1 Mar. 25, 2010

(51) Int. Cl.
*B25B 13/46* (2006.01)
*B25B 13/08* (2006.01)

(52) U.S. Cl. ..... 81/179; 81/186

(58) Field of Classification Search ..... 81/179, 81/165, 186, 92, 94
See application file for complete search history.

(56) References Cited

U.S. PATENT DOCUMENTS 1,320,668 A * 11/1919 Askman ..... 81/179
2,846,912 A * 8/1958 Day ..... 81/179
3,695,125 A * 10/1972 Glass et al. ..... 81/179
4,158,975 A * 6/1979 DeSousa ..... 81/179
5,287,777 A * 2/1994 Kolodziej ..... 81/179

* cited by examiner

*Primary Examiner*—David B Thomas

(57) ABSTRACT

A reciprocatable open end wrench comprises a swing member allowing to slide relative to a concave arcuate surface of a second jaw, the radius of a convex arcuate surface of the swing member is equal to that of a concave arcuate surface of the second jaw, and between the concave arcuate surface and the convex arcuate surface is provided with an engagement structure having a slot member and a peripheral protrusion so as to engage with each other. Besides, the reciprocatable open end wrench further includes a stop portion for resisting against the torque of the swing member, thereby enhancing the strength and preventing the related components to be damaged.

14 Claims, 6 Drawing Sheets

RECIPROCATABLE OPEN END WRENCH

BACKGROUND OF THE INVENTION

1. Field of the Invention

The present invention relates to an open end wrench, and more particularly to a reciprocatable open end wrench that can prevent the related components from being damaged.

2. Description of the Prior Art

Conventional open end wrenches are produced easily, but they can not be operated quickly.

To solve such a question, many improved open end wrenches have been developed, however they still have some disadvantages. For example, U.S. Pat. No. 4,158,975 discloses a unidirectional gripping open end wrench, and the radius of the arcuate surface of the D-shaped member is less than that of the concave arcuate surface of the jaw, hence as wrenching the fastening element, the D-shaped member contacts with the concave arcuate surface by one point contacting manner, and most of torque is forced on the projection on the side of the D-shaped member, thus causing the damage of the projection, and the open end wrench has lower strength. Besides, the upper and lower cover plates have to be disposed on the wrench to clamp and position the D-shaped member, thereby the open end wrench has to be produced in higher cost and tedious manufacturing process.

Likewise, the conventional open end wrenches disclose in the U.S. Pat. No. 3,695,125 and U.S. Pat. No. 4,158,975 have the same disadvantages exist.

The present invention has arisen to mitigate and/or obviate the afore-described disadvantages.

SUMMARY OF THE INVENTION

The primary objective of the present invention is to provide a reciprocatable open end wrench that can enhance the strength and prevent the related components from being damaged.

To achieve the above-mentioned objectives, the reciprocatable open end wrench provided in accordance with the present invention comprises a handle and at least one driving head, the driving head being located at one end of the handle, wherein the driving head comprises:

a first jaw includes a first clamping surface;

a second jaw, the second jaw is disposed to correspond to the first jaw and includes a concave arcuate surface disposed on the inner side thereof;

a swing member includes a second clamping surface and a convex arcuate surface, between the first clamping surface and the second clamping surface is formed a working area, the radius of the convex arcuate surface is equal to that of the concave arcuate surface, and the swing member allows to slide relative to the concave arcuate surface;

a bottom surface, the bottom surface is located between the first jaw and the swing member, and the bottom surface includes a midpoint for dividing the width of the working area into two parts;

a stop portion, the stop portion is fixed between the second jaw and the swing member, as the open end wrench rotates a fastening element in one direction, the stop portion resists against the torque of the swing member; and a returning device, one end of the returning device is biased against the swing member so that the swing member moves close to the stop portion at any time;

wherein between the concave arcuate surface and the convex arcuate surface is provided with an engagement structure which includes a slot member and a peripheral protrusion, both are disposed around the arcuate surface, so as to engage the swing member with the second jaw;

wherein the thicknesses of the swing member and the second jaw are equal;

wherein on the curve line of the convex arcuate surface of the swing member forms a center, and the height difference between the center of the convex arcuate surface and the midpoint of the bottom surface is H, the width of the working area is S, wherein the relation between S and H is $$29\% S<H<58\% S.$$

DETAILED DESCRIPTION OF THE PREFERRED EMBODIMENT

The present invention will be clearer from the following description when viewed together with the accompanying drawings, which show, for purpose of illustrations only, the preferred embodiment in accordance with the present invention.

Figure 1:
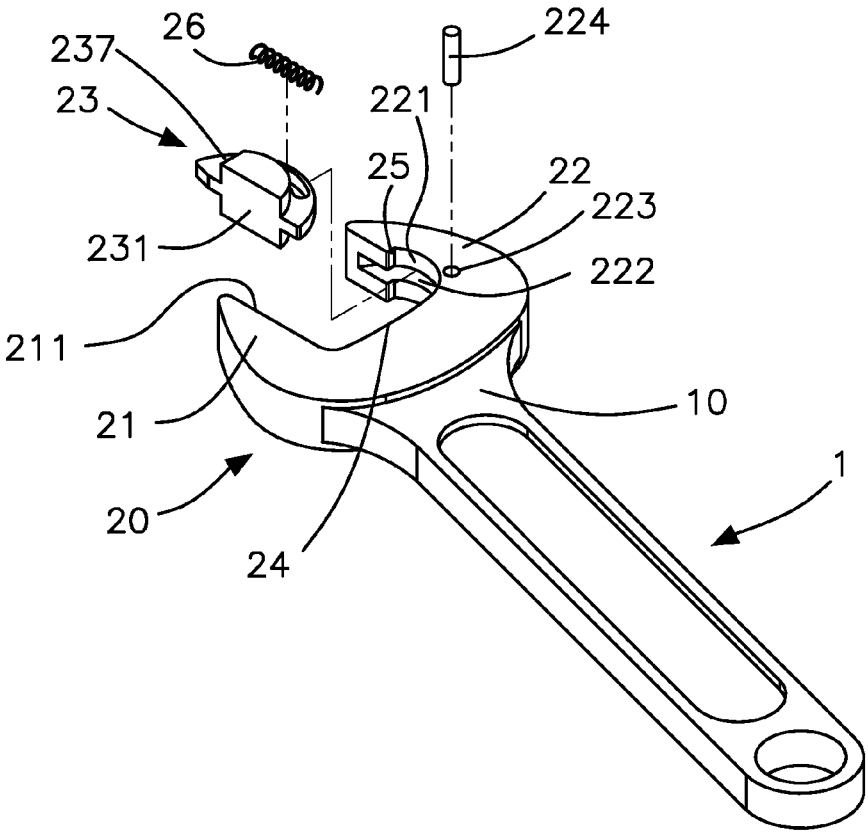
FIG. 1 is a perspective view illustrating the exploded components of a reciprocatable open end wrench according to a first embodiment of the present invention.
Figure 2:
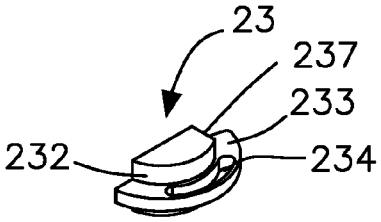
FIG. 2 is a perspective view illustrating the assembly of a swing member of the reciprocatable open end wrench according to the first embodiment of the present invention.

Referring to FIGS. 1 and 2, an open end wrench 1 in accordance with a first embodiment of the present invention comprises a handle 10 and a driving head 20, the driving head 20 being located at one end of the handle 10, and the driving head 20 including a first jaw 21, a second jaw 22, a swing member 23, a bottom surface 24, a stop portion 25, and a returning device 26, wherein the first jaw 21 includes a first clamping surface 211, and the second jaw 22 is disposed to correspond to the first jaw 21 and includes a concave arcuate surface 221 disposed on the inner side thereof and having a first slot 222 formed thereon. The second jaw 22 further includes a through bore 223 and a retaining pin 224, and the through bore 223 is in communication with the first slot 222 and the exterior.

The swing member 23 includes a second clamping surface 231 and a convex arcuate surface 232, between the second clamping surface 231 and the first clamping surface 211 is formed a working area, the radius of the convex arcuate surface 232 is equal to that of the concave arcuate surface 221, and the swing member 23 allows to slide relative to the concave arcuate surface 221, wherein the convex arcuate surface 232 includes a first peripheral protrusion 233 mounted therearound and engaging with the first slot 222 and having an arcuate hollow groove 234, and the radius of the first slot 222 is greater than that of the first peripheral protrusion 233. Besides, the through bore 223 of the second jaw 22 is in response to the hollow groove 234, and the retaining pin 224 is inserted into the hollow groove 234 through the through bore 223 so as to be limited to move in the hollow groove 234 and to prevent the swing member 23 from disengagement from the second jaw 22. The thickness of the swing member 23 is approximately identical to that of the second jaw 22.

The bottom surface 24 is located between the first jaw 21 and the swing member 23, and the bottom surface 24 includes a midpoint for dividing the width of the working area into two parts. The stop portion 25 is fixed between the second jaw 22 and the swing member 23, e.g., the stop portion 25 is attached on the upper periphery of the concave arcuate surface 221 so as to engage with the swing member 23.

The returning device 26 is installed between one end of the hollow groove 234 and the retaining pin 224, e.g., one end of the returning device 26 is biased against the swing member 23 so that the convex arcuate surface 232 of the swing member 23 moves close to the stop portion 25.

Figure 3:
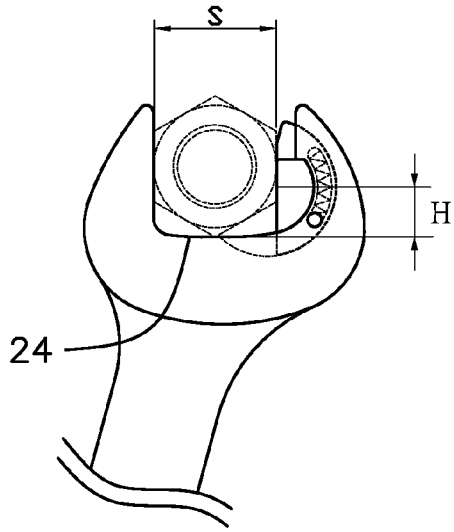
FIG. 3 is a plan view illustrating the reciprocatable open end wrench being used to engage a fastening element according to the first embodiment of the present invention.

With reference to FIG. 3, on the curve line of the convex arcuate surface 232 forms a center, and the height difference between the center of the convex arcuate surface 232 and the midpoint of the bottom surface 24 is H, the width of the working area is S, wherein the relation between S and H is $$29\% S<H<58\% S.$$

When the height difference is within the above-mentioned range, the user can rotate a fastening element in the clockwise direction; on the contrary, as the user rotates the open end wrench in the counter-clockwise direction, the open end wrench rotates idly to return back to its original position so as not to drive the fastening element.

Figure 4:
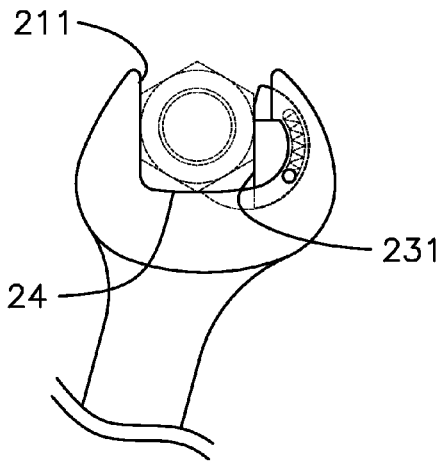
FIG. 4 is a plan view illustrating the operation of the reciprocatable open end wrench according to the first embodiment of the present invention.
Figure 5:
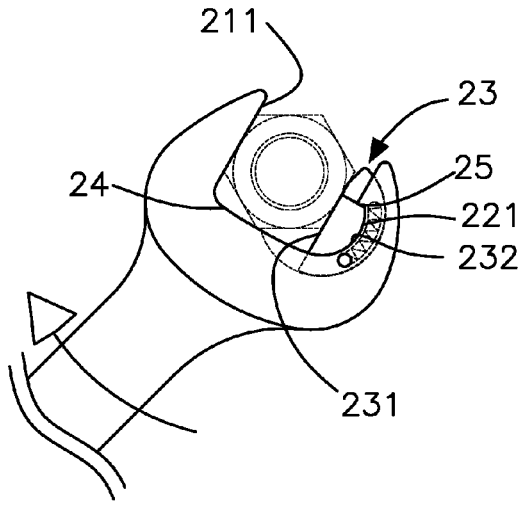
FIG. 5 is also a plan view illustrating the operation of the reciprocatable open end wrench according to the first embodiment of the present invention.
Figure 6:
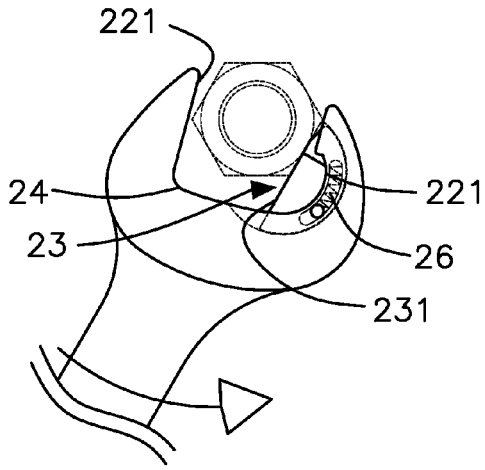
FIG. 6 is another plan view illustrating the operation of the reciprocatable open end wrench according to the first embodiment of the present invention.
Figure 7:
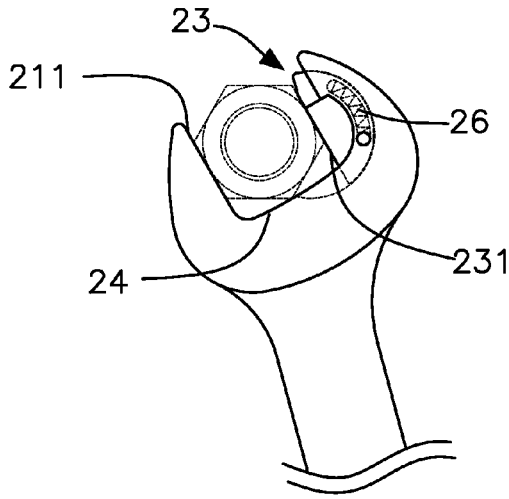
FIG. 7 is also another plan view illustrating the operation of the reciprocatable open end wrench according to the first embodiment of the present invention.

Referring to FIGS. 4-7, they show a reciprocatable open end wrench according to the first embodiment of the present invention. In operation, as shown in FIG. 4, the open end wrench 1 is used to engage the fastening element which is located at the working area, in the meantime, the two opposite sides of the fastening element are matingly engaged by the first and second clamping surfaces 211 and 231, and one of the peaks of the fastening element contacts with the midpoint of the bottom surface 24. Referring further to FIG. 5, as rotating the open end wrench in the clockwise direction, the first and second clamping surfaces 211 and 231 offer an action force to the fastening element, wherein the fastening element generates a reaction force which is passed from the convex arcuate surface 232 to the concave arcuate surface 221 against the swing member 23, and the stop portion 25 resists against the torque of the swing member 23 so that the fastening element is driven to rotate in the clockwise direction. As shown in FIG. 6, as rotating the open end wrench in the counter-clockwise direction, the fastening element produces a reaction force against the swing member 23 so that the swing member 23 slides downward along the concave arcuate surface 221 and compresses the returning device 26, the fastening element can be rotated in the clockwise direction in the working area relative to the first and second clamping surfaces 211, 231. After the reciprocatable open end wrench 1 returns back to 60 degrees in the counter-clockwise direction as illustrated in FIG. 7, the first clamping surface 211 contacts with one side of the fastening element again, and the returning device 26 pushes the swing member 23 back to its initial location, thus enabling the user to rotate the fastening element again in the clockwise direction.

Figure 8:
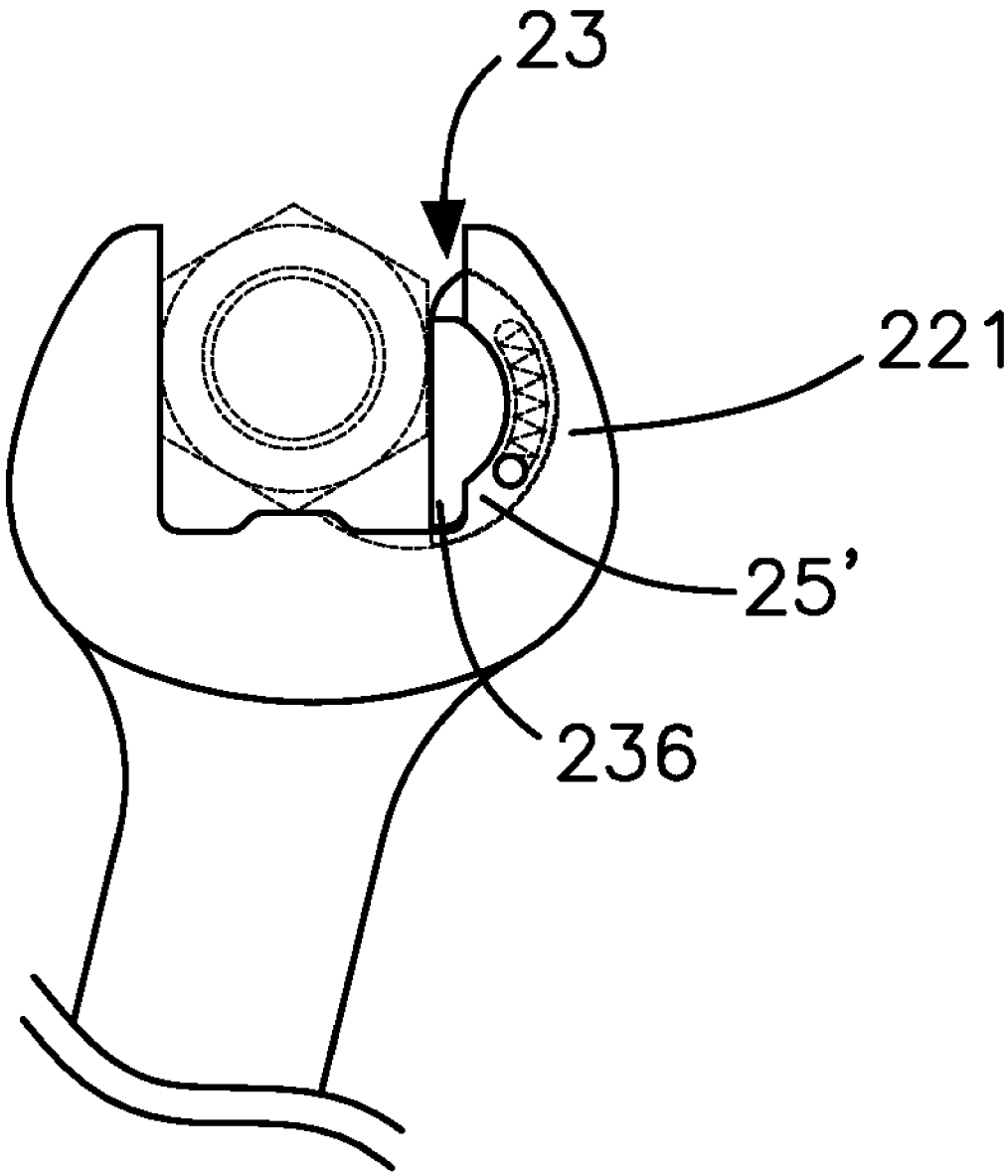
FIG. 8 is a plan view illustrating the assembly of a reciprocatable open end wrench according to a second embodiment of the present invention.

With reference to FIG. 8, it shows a reciprocatable open end wrench according to a second embodiment of the present invention, and its differences from the first embodiment of the present invention are that the swing member 23 includes an extended tab 236 secured on the lower end rim thereof, and a stop portion 25 is in response to the extended tab 236 and disposed on the lower end of the concave arcuate surface 221 so as to bias against the extended tab 236.

Figure 9:
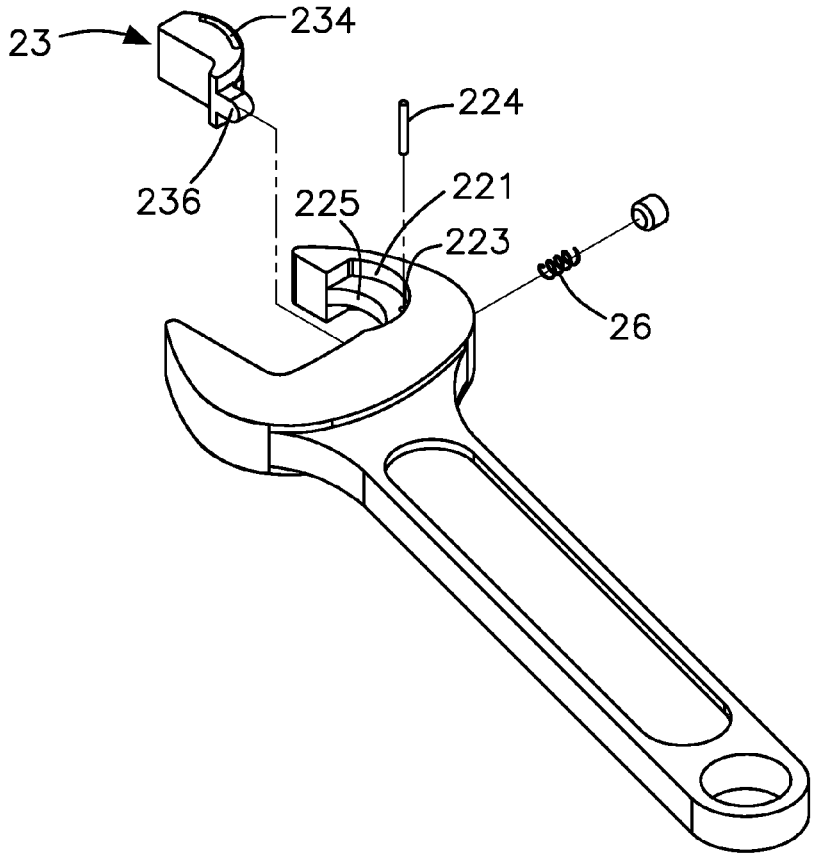
FIG. 9 is a perspective view illustrating the exploded components of a reciprocatable open end wrench according to a third embodiment of the present invention.
Figure 10:
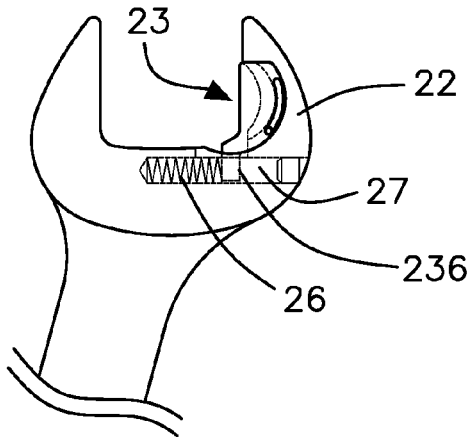
FIG. 10 is a plan view illustrating the assembly of a reciprocatable open end wrench according to the third embodiment of the present invention.
Figure 11:
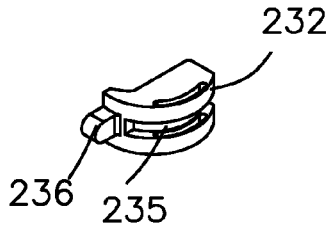
FIG. 11 is a perspective view illustrating the assembly of a swing member of the reciprocatable open end wrench according to the third embodiment of the present invention.

Referring to FIGS. 9-11, they show a reciprocatable open end wrench according to a third embodiment of the present invention. The descriptions of the parts of the third embodiment are identical to the parts of the first embodiment may be omitted for the sake of brevity. Only those different parts are described herein. On the convex arcuate surface 232 of the swing member 23 is mounted a second slot 235, and on the concave arcuate surface 221 of the second jaw 22 is fixed a second peripheral protrusion 225, the radius of the second peripheral protrusion 225 is larger than that of the second slot 235, but the convex arcuate surface 232 of the swing member 23 is equal to that of the concave arcuate surface 221. Furthermore, below the second jaw 22 is formed an internal hole 27 in which a returning device 26 is installed, and on the lower end of the swing member 23 is arranged an extended tab 236, and one end of the extended tab 236 is used to bias against the returning device 26.

In the third embodiment of the present invention, the through bore and the retaining pin can also be secured on the swing member, and the hollow groove can be disposed on the second peripheral protrusion of the second jaw, thereby preventing the swing member and the second jaw from disengagement.

Figure 12:
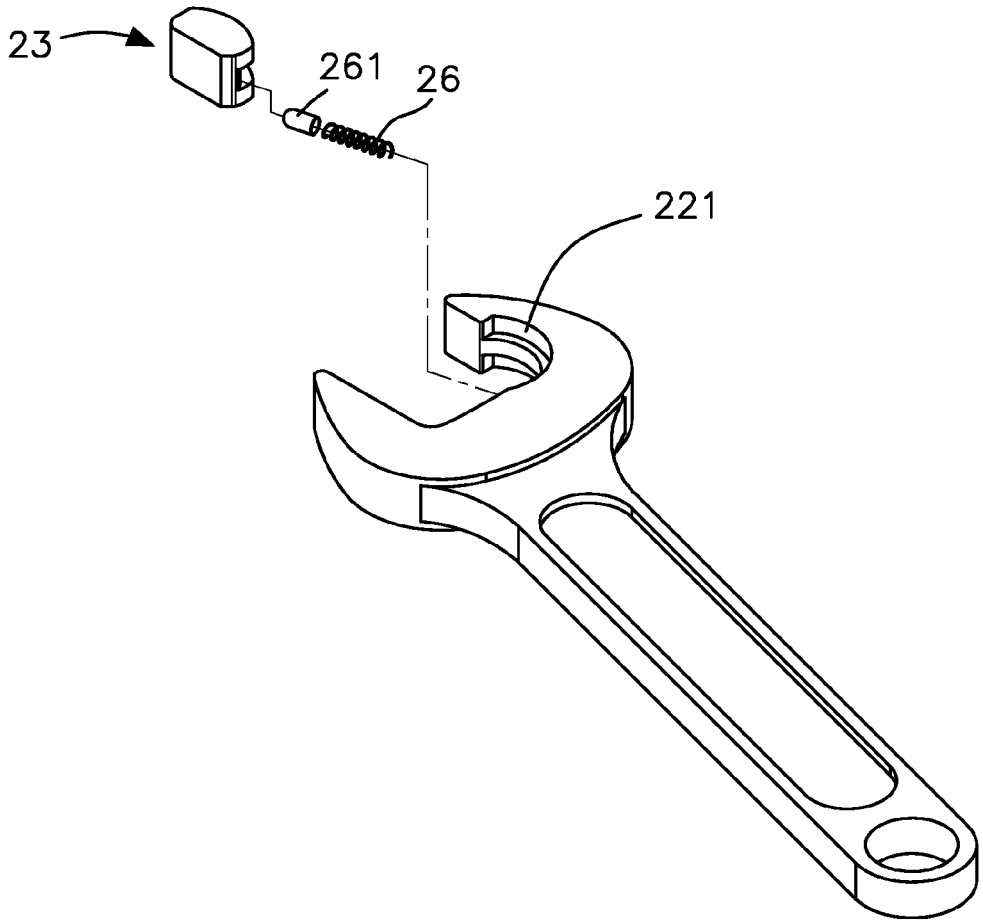
FIG. 12 is a perspective view illustrating the exploded components of a reciprocatable open end wrench according to a fourth embodiment of the present invention.
Figure 13:
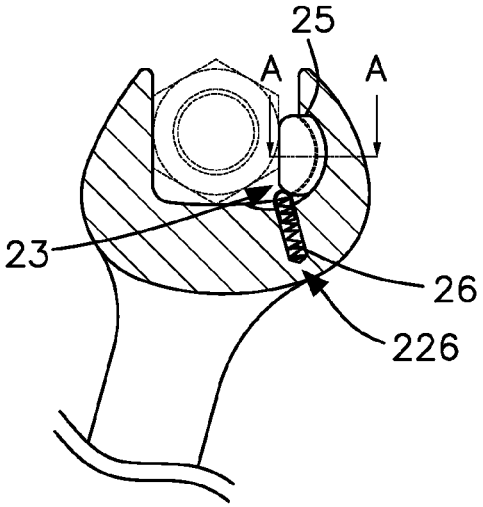
FIG. 13 is a plan view illustrating the assembly of a reciprocatable open end wrench according to the fourth embodiment of the present invention.

As shown in FIGS. 12 and 13, they show a reciprocatable open end wrench according to a fourth embodiment of the present invention. The difference between the present embodiment and the fourth embodiment is that a returning device 26 is installed in an aperture 226 below the concave arcuate surface 221, one end of the returning device 26 contacts with a biasing element 261 for pushing the swing member 23 to move close to a stop portion 25.

Figure 14:
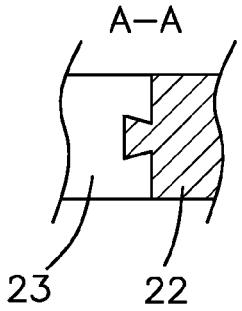
FIG. 14 is a cross sectional view taken along the line A-A of FIG. 13.

Referring to FIG. 14, it is a cross sectional view taken along the line A-A of FIG. 13, wherein the slot member is designed to a dovetail slot, and the shape of a third peripheral protrusion is in response to the dovetail slot so as to engage with each other, thereby preventing the swing member from disengagement from the second jaw. Furthermore, when the slot member is formed in the shape of a dovetail slot, the through bore, the hollow first slot, and the retaining pin can be eliminated from the structure of the open end wrench.

Figure 15:
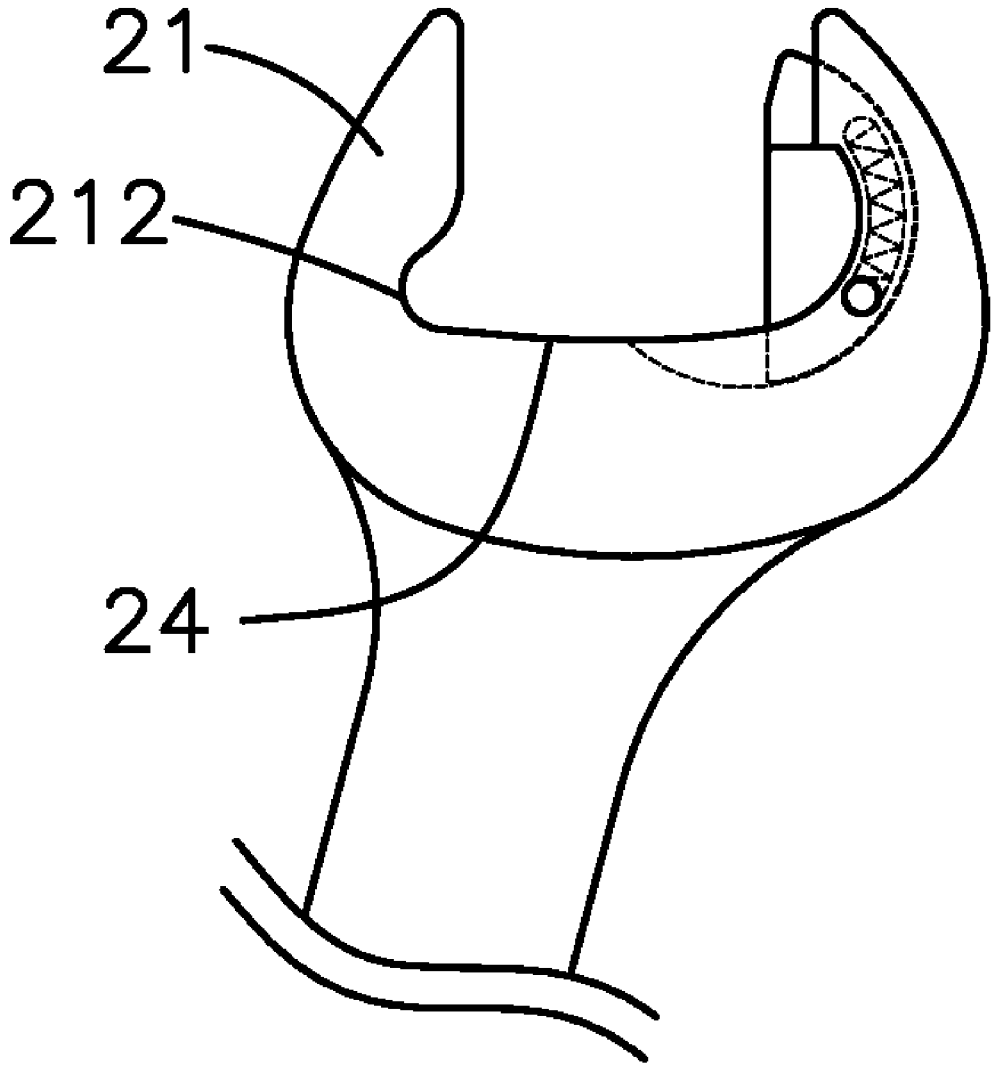
FIG. 15 is a plan view illustrating the assembly of a reciprocatable open end wrench according to a fifth embodiment of the present invention.

As illustrated in FIG. 15, it shows a reciprocatable open end wrench according to a fifth embodiment of the present invention, wherein the first jaw 21 includes an inner curved cavity 212 disposed adjacent to the bottom surface 24 thereof so that as the wrench is rotated in the counter-clockwise direction, the fastening element in the working area can be rotated freely in a wider space.

It can be clearly seen from the preceding accounts on the features of the present invention that the reciprocatable open end wrench of the present invention has the following advantages:

1. The open end wrench includes the slot member and the peripheral protrusion so as to engage with each other, thus preventing the swing member from swing and simplifying the necessary components, such as the conventional cover plates in the driving head. Besides, it has higher mechanical strength than the conventional cover plates.

2. Because the radiuses of the concave and convex arcuate surfaces are the same, the swing member can matingly engage with the second jaw, such that as rotating the fastening member, the convex arcuate surface of the swing member passes the force to the second jaw to obtain higher structural strength and to prevent the retaining pin or the swing member from being damaged due to the force is concentrated on the retaining pin.

3. By arranging the stop portion, the torque on the swing member forced by the fastening element can be resisted to stop the swing member from disengagement and the torque from concentration on the retaining pin.

4. Because the thicknesses of the swing member and the second jaw are equal, obtaining better strength.

5. The engagement structure can be designed to a dovetail slot for matching with a third peripheral protrusion, therefore the swing member can more tightly engage with the second jaw, avoiding the power waste due to the swinging of the swing member.

While we have shown and described various embodiments in accordance with the present invention, it is clear to those skilled in the art that further embodiments may be made without departing from the scope of the present invention.

What is claimed is:

1. A reciprocatable open end wrench comprises a handle and at least one driving head, the driving head being located at one end of the handle, wherein the driving head comprises:

a first jaw includes a first clamping surface;

a second jaw, the second jaw is disposed to correspond to the first jaw and includes a concave arcuate surface disposed on the inner side thereof;

a swing member includes a second clamping surface and a convex arcuate surface, between the first clamping surface and the second clamping surface is formed a working area, the radius of the convex arcuate surface is equal to that of the concave arcuate surface, and the swing member allows to slide relative to the concave arcuate surface;

a bottom surface, the bottom surface is located between the first jaw and the swing member, and the bottom surface includes a midpoint for dividing the width of the working area into two parts;

a stop portion, the stop portion is fixed between the second jaw and the swing member, as the open end wrench rotates a fastening element in one direction, the stop portion resists against the torque of the swing member; and a returning device, one end of the returning device is biased against the swing member so that the swing member moves close to the stop portion at any time;

wherein between the concave arcuate surface and the convex arcuate surface is provided with an engagement structure which includes a slot member and a peripheral protrusion, both are disposed around the arcuate surfaces, so as to engage the swing member with the second jaw;

wherein the thicknesses of the swing member and the second jaw are equal;

wherein on the curve line of the convex arcuate surface of the swing member forms a center, and the height difference between the center of the convex arcuate surface and the midpoint of the bottom surface is H, the width of the working area is S, wherein the relation between S and H is $$29\% S<H<58\% S;$$

wherein a second slot of the engagement structure is mounted on the convex arcuate surface of the swing member, and a second peripheral protrusion of the engagement structure is fixed on the concave arcuate surface of the second jaw, the radius of the second peripheral protrusion is larger than that of the second slot.

2. The reciprocatable open end wrench as claimed in claim 1, wherein the swing member further includes a through bore and a retaining pin, and the second peripheral protrusion of the second jaw includes an arcuate hollow groove, the through bore is in communication with the second slot and the exterior and is in response to the hollow groove, and the retaining pin is inserted into the hollow groove through the through bore; besides, the returning device is installed between one end of the hollow groove and the retaining pin.

3. The reciprocatable open end wrench as claimed in claim 1, wherein the driving head further includes an internal hole formed below the second jaw and communicating with the second slot; furthermore, the returning device is installed between the internal hole and the swing member.

4. The reciprocatable open end wrench as claimed in claim 1, wherein the second slot is a dovetail slot, and the shape of the second peripheral protrusion is in response to the second slot.

5. A reciprocatable open end wrench comprises a handle and at least one driving head, the driving head being located at one end of the handle, wherein the driving head comprises:

a first jaw includes a first clamping surface;

a second jaw, the second jaw is disposed to correspond to the first jaw and includes a concave arcuate surface disposed on the inner side thereof;

a swing member includes a second clamping surface and a convex arcuate surface, between the first clamping surface and the second clamping surface is formed a working area, the radius of the convex arcuate surface is equal to that of the concave arcuate surface, and the swing member allows to slide relative to the concave arcuate surface;

a bottom surface, the bottom surface is located between the first jaw and the swing member, and the bottom surface includes a midpoint for dividing the width of the working area into two parts;

a stop portion, the stop portion is fixed between the second jaw and the swing member, as the open end wrench rotates a fastening element in one direction, the stop portion resists against the torque of the swing member; and a returning device, one end of the returning device is biased against the swing member so that the swing member moves close to the stop portion at any time;

wherein between the concave arcuate surface and the convex arcuate surface is provided with an engagement structure which includes a slot member and a peripheral protrusion, both are disposed around the arcuate surfaces, so as to engage the swing member with the second jaw;

wherein the thicknesses of the swing member and the second jaw are equal;

wherein on the curve line of the convex arcuate surface of the swing member forms a center, and the height difference between the center of the convex arcuate surface and the midpoint of the bottom surface is H, the width of the working area is S, wherein the relation between S and H is $$29\% S<H<58\% S;$$

wherein a first slot of the engagement structure is formed on the concave arcuate surface of the second jaw, a first peripheral protrusion of the engagement structure is mounted around the convex arcuate surface of the swing member, and the radius of the first slot is greater than that of the first peripheral protrusion;

wherein the second jaw further includes a through bore and a retaining pin, a first peripheral protrusion of the swing member has an arcuate hollow groove, the through bore is in communication with the first slot and the exterior and is in response to the hollow groove, and the retaining pin is inserted into the hollow groove through the through bore; besides, the returning device is installed between one end of the hollow groove and the retaining pin.

6. The reciprocatable open end wrench as claimed in claim 5, wherein the first slot is a dovetail slot, and the shape of the first peripheral protrusion is in response to the first slot.

7. A reciprocatable open end wrench comprises a handle and at least one driving head, the driving head being located at one end of the handle, wherein the driving head comprises:

a first jaw includes a first clamping surface;

a second jaw, the second jaw is disposed to correspond to the first jaw and includes a concave arcuate surface disposed on the inner side thereof;

a swing member includes a second clamping surface and a convex arcuate surface, between the first clamping surface and the second clamping surface is formed a working area, the radius of the convex arcuate surface is equal to that of the concave arcuate surface, and the swing member allows to slide relative to the concave arcuate surface;

a bottom surface, the bottom surface is located between the first jaw and the swing member, and the bottom surface includes a midpoint for dividing the width of the working area into two parts;

a stop portion, the stop portion is fixed between the second jaw and the swing member, as the open end wrench rotates a fastening element in one direction, the stop portion resists against the torque of the swing member; and a returning device, one end of the returning device is biased against the swing member so that the swing member moves close to the stop portion at any time;

wherein between the concave arcuate surface and the convex arcuate surface is provided with an engagement structure which includes a slot member and a peripheral protrusion, both are disposed around the arcuate surfaces, so as to engage the swing member with the second jaw;

wherein the thicknesses of the swing member and the second jaw are equal;

wherein on the curve line of the convex arcuate surface of the swing member forms a center, and the height difference between the center of the convex arcuate surface and the midpoint of the bottom surface is H, the width of the working area is S, wherein the relation between S and H is $$29\% S<H<58\% S;$$

wherein the first jaw includes an inner curved cavity disposed adjacent to the bottom surface thereof.

8. A reciprocatable open end wrench comprises a handle and at least one driving head, the driving head being located at one end of the handle, wherein the driving head comprises:

a first jaw includes a first clamping surface;

a second jaw, the second jaw is disposed to correspond to the first jaw and includes a concave arcuate surface disposed on the inner side thereof;

a swing member includes a second clamping surface and a convex arcuate surface, between the first clamping surface and the second clamping surface is formed a working area, and the swing member allows to slide relative to the concave arcuate surface;

a bottom surface, the bottom surface is located between the first jaw and the swing member, and the bottom surface includes a midpoint for dividing the width of the working area into two parts;

a returning device, one end of the returning device is biased against the swing member so that the second clamping surface of the swing member is parallel to the first clamping surface at any time;

wherein on the curve line of the convex arcuate surface of the swing member forms a center, and the height difference between the center of the convex arcuate surface and the midpoint of the bottom surface is H, the width of the working area is S, wherein the relation between S and H is $$29\% S<H<58\% S;$$

wherein around the concave arcuate surface of the second jaw is formed a second peripheral protrusion, and around the convex arcuate surface of the swing member is mounted a second slot so as to engage the swing member with the second jaw, and the radius of the second peripheral protrusion is greater than that of the second slot.

9. The reciprocatable open end wrench as claimed in claim 8, wherein the swing member further includes a through bore and a retaining pin, and the second peripheral protrusion of the second jaw includes an arcuate hollow groove, the through bore is in communication with the second slot and the exterior and is in response to the hollow groove, and the retaining pin is inserted into the hollow groove through the through bore; besides, the returning device is installed between one end of the hollow groove and the retaining pin.

10. The reciprocatable open end wrench as claimed in claim 8, wherein the driving head further includes an internal hole formed below the second jaw and communicating with the second slot; furthermore, the returning device is installed between the internal hole and the swing member.

11. The reciprocatable open end wrench as claimed in claim 8, wherein the second slot is a dovetail slot, and the shape of the second peripheral protrusion is in response to the second slot.

12. A reciprocatable open end wrench comprises a handle and at least one driving head, the driving head being located at one end of the handle, wherein the driving head comprises:

a first jaw includes a first clamping surface;

a second jaw, the second jaw is disposed to correspond to the first jaw and includes a concave arcuate surface disposed on the inner side thereof;

a swing member includes a second clamping surface and a convex arcuate surface, between the first clamping surface and the second clamping surface is formed a working area, and the swing member allows to slide relative to the concave arcuate surface;

a bottom surface, the bottom surface is located between the first jaw and the swing member, and the bottom surface includes a midpoint for dividing the width of the working area into two parts;

a returning device, one end of the returning device is biased against the swing member so that the second clamping surface of the swing member is parallel to the first clamping surface at any time;

wherein on the curve line of the convex arcuate surface of the swing member forms a center, and the height difference between the center of the convex arcuate surface and the midpoint of the bottom surface is H, the width of the working area is S, wherein the relation between S and H is $$29\% S<H<58\% S;$$

wherein around the concave arcuate surface of the second jaw is formed a first slot, and around the convex arcuate surface of the swing member is mounted a first peripheral protrusion so as to engage the swing member with the second jaw, and the radius of the first slot is greater than that of the first peripheral protrusion;

wherein the second jaw further includes a through bore and a retaining pin, a first peripheral protrusion of the swing member has an arcuate hollow groove, the through bore is in communication with the first slot and the exterior and is in response to the hollow groove, and the retaining pin is inserted into the hollow groove through the through bore; besides, the returning device is installed between one end of the hollow groove and the retaining pin.

13. A reciprocatable open end wrench comprises a handle and at least one driving head, the driving head being located at one end of the handle, wherein the driving head comprises:

a first jaw includes a first clamping surface;

a second jaw, the second jaw is disposed to correspond to the first jaw and includes a concave arcuate surface disposed on the inner side thereof;

a swing member includes a second clamping surface and a convex arcuate surface, between the first clamping surface and the second clamping surface is formed a working area, and the swing member allows to slide relative to the concave arcuate surface;

a bottom surface, the bottom surface is located between the first jaw and the swing member, and the bottom surface includes a midpoint for dividing the width of the working area into two parts;

a returning device, one end of the returning device is biased against the swing member so that the second clamping surface of the swing member is parallel to the first clamping surface at any time;

wherein on the curve line of the convex arcuate surface of the swing member forms a center, and the height difference between the center of the convex arcuate surface and the midpoint of the bottom surface is H, the width of the working area is S, wherein the relation between S and H is $$29\% S<H<58\% S;$$

wherein around the concave arcuate surface of the second jaw is formed a first slot, and around the convex arcuate surface of the swing member is mounted a first peripheral protrusion so as to engage the swing member with the second jaw, and the radius of the first slot is greater than that of the first peripheral protrusion;

wherein the first slot is a dovetail slot, and the shape of the first peripheral protrusion is in response to the first slot.

14. A reciprocatable open end wrench comprises a handle and at least one driving head, the driving head being located at one end of the handle, wherein the driving head comprises:

a first jaw includes a first clamping surface;

a second jaw, the second jaw is disposed to correspond to the first jaw and includes a concave arcuate surface disposed on the inner side thereof;

a swing member includes a second clamping surface and a convex arcuate surface, between the first clamping surface and the second clamping surface is formed a working area, and the swing member allows to slide relative to the concave arcuate surface;

a bottom surface, the bottom surface is located between the first jaw and the swing member, and the bottom surface includes a midpoint for dividing the width of the working area into two parts;

a returning device, one end of the returning device is biased against the swing member so that the second clamping surface of the swing member is parallel to the first clamping surface at any time;

wherein on the curve line of the convex arcuate surface of the swing member forms a center, and the height difference between the center of the convex arcuate surface and the midpoint of the bottom surface is H, the width of the working area is S, wherein the relation between S and H is $$29\% S<H<58\% S;$$

wherein the first jaw includes an inner curved cavity disposed adjacent to the bottom surface thereof.

* * * * *